US010246918B2

(12) United States Patent
Friz

(10) Patent No.: US 10,246,918 B2
(45) Date of Patent: Apr. 2, 2019

(54) DOOR HINGE OR WINDOW HINGE

(71) Applicant: SFS intec Holding AG, Heerbrugg (CH)

(72) Inventor: Fabio Polo Friz, Giais di Aviano (IT)

(73) Assignee: SFS intec Holding AG, Heerbrugg (CH)

( * ) Notice: Subject to any disclaimer, the term of this patent is extended or adjusted under 35 U.S.C. 154(b) by 0 days.

(21) Appl. No.: 15/544,755

(22) PCT Filed: Dec. 14, 2015

(86) PCT No.: PCT/EP2015/079549
§ 371 (c)(1),
(2) Date: Jul. 19, 2017

(87) PCT Pub. No.: WO2016/146218
PCT Pub. Date: Sep. 22, 2016

(65) Prior Publication Data

US 2017/0362867 A1 Dec. 21, 2017

(30) Foreign Application Priority Data

Mar. 17, 2018 (DE) ..... 10 2015 003 439

(51) Int. Cl.

| | |
|---|---|
| ***E05D 7/04*** | (2006.01) |
| ***E05D 5/02*** | (2006.01) |
| ***E05D 7/00*** | (2006.01) |
| ***E05D 3/02*** | (2006.01) |

(52) U.S. Cl.
CPC ..... *E05D 7/0423* (2013.01); *E05D 3/02* (2013.01); *E05D 5/023* (2013.01); *E05D 5/0223* (2013.01);
(Continued)

(58) Field of Classification Search
CPC ..... E05D 7/04; E05D 7/0415; E05D 7/0423; E05D 7/043; E05D 7/0009; E05D 7/0018;
(Continued)

(56) References Cited

U.S. PATENT DOCUMENTS 609,756 A * 8/1898 Curry ..... E05D 7/04 16/235
6,516,494 B2 * 2/2003 Nakamoto ..... E05D 7/0027 16/236
(Continued)

FOREIGN PATENT DOCUMENTS

| | | |
|---|---|---|
| DE | 9006439 | 8/1990 |
| DE | 4337626 | 1/1995 |
| DE | 102007028218 | 7/2008 |

*Primary Examiner* — Jeffrey O'Brien
(74) *Attorney, Agent, or Firm* — Volpe and Koenig, P.C.

(57) ABSTRACT

A door hinge (1) or window hinge (1) having two hinge parts (2,4) which are operatively connected to one another so as to be rotatable about a common hinge axis (2), wherein at least one door-or-window-side first hinge part (3) has a plate-like portion (8) which interacts in a fixedly and releasably connectable manner with a holding piece (9) which can be inserted into a groove in the end side of the door or window, wherein the plate-like portion (8) is oriented in an imaginary plane running parallel to the hinge axis (2) and is adjustable with respect to the holding piece (9) in an imaginary plane running at a right angle to the plane of the plate-like portion (8), and wherein an adjustment screw (11) can be screwed into at least one thread (1) of the holding piece (9). Provision is made for a head (12) of the adjustment screw (11) to be arranged between an intermediate piece (14) and the plate-like portion (8) by a clamping device (5) which applies to force to the plate-like portion (8) and the intermediate piece from opposite side and thus hold them together.

4 Claims, 4 Drawing Sheets

(52) U.S. Cl.
CPC ..... *E05D 7/0027* (2013.01); *E05D 7/0415* (2013.01); *E05D 2003/027* (2013.01); *E05D 2007/0469* (2013.01); *E05D 2007/0492* (2013.01); *E05Y 2900/132* (2013.01); *E05Y 2900/148* (2013.01); *Y10T 16/5321* (2015.01)

(58) Field of Classification Search
CPC ... E05D 7/0027; E05D 7/0045; E05D 7/0054; E05D 2007/0438; E05D 2007/0446; E05D 2007/0453; E05D 2007/0461; E05D 2007/0469; E05D 2007/0476; E05D 2007/0484; E05D 2007/0492; E05D 2007/0072; Y10T 16/5321; Y10T 16/5322; Y10T 16/53225; Y10T 16/5323; Y10T 16/53235; Y10T 16/53257; Y10T 16/5327; Y10T 16/5329
See application file for complete search history.

(56) References Cited

U.S. PATENT DOCUMENTS 6,757,939 B2 * 7/2004 Mueller ..... E05D 7/0407 16/236
7,571,516 B2 * 8/2009 Lueffe ..... E05D 7/0423 16/235
7,653,967 B2 * 2/2010 Lowe ..... E05D 7/0407 16/238
8,276,241 B2 * 10/2012 Wu ..... E05D 7/0415 16/235
8,413,299 B2 * 4/2013 Bartels ..... E05D 7/0423 16/236
9,416,573 B2 * 8/2016 Sabrowski ..... E05D 7/0415
9,617,769 B2 * 4/2017 Polo Friz ..... E05D 3/186
9,976,327 B2 * 5/2018 Dreisewerd ..... E05D 7/0423
2002/0073509 A1 * 6/2002 Dean ..... E05D 7/0415 16/387
2008/0016648 A1 * 1/2008 Lautenschlager ..... E05D 7/0415 16/238
2008/0104799 A1 * 5/2008 Hoppe ..... E05D 7/0027 16/238
2008/0271291 A1 * 11/2008 Chen ..... E05D 7/0407 16/238
2008/0307606 A1 * 12/2008 Karlsson ..... E05D 7/0415 16/243
2010/0115729 A1 * 5/2010 Neukoetter ..... E05D 3/186 16/235

* cited by examiner

DOOR HINGE OR WINDOW HINGE

BACKGROUND

The invention relates to a door or window hinge having two hinge parts which are operatively connected to one another so as to be rotatable about a common hinge axis, wherein at least one door- or window-side first hinge part has a plate-like portion which interacts in a fixedly and releasably connectable manner with a retaining piece which can be inserted into a groove in the end side of the door or window, wherein the plate-like portion is oriented in an imaginary plane running parallel to the hinge axis and is adjustable with respect to the retaining piece in an imaginary plane running at right angles to the plane of the plate-like portion, and wherein an adjustment screw can be screwed into at least one thread of the retaining piece, wherein an axis of the adjustment screw runs perpendicular to the plate-like portion.

Such a hinge is known from DE 10 2007 028 218 B3. This hinge offers a plurality of adjustment options in different directions. To allow an adjustment of the hinge perpendicular to the plate-like portion and perpendicular to the hinge axis, an adjusting screw is provided, the screw head of which is arranged between the plate-like portion and an intermediate piece, which in turn is connected to the retaining piece. In order to hold the plate-like portion and the intermediate piece together, screws are provided which pass through holes in the plate-like portion and are screwed into threads of the intermediate piece or into threaded sleeves formed on the intermediate piece. This means that the plate-like portion and the intermediate piece are rigidly fixed together. If it is necessary for the purpose of adjustment to move the plate-like portion and the intermediate piece towards one another in parallel to the plate-like portion and perpendicular to the hinge axis, then the screws holding the plate-like portion and the intermediate piece together must first be released. Only then is it possible to use a further adjustment screw, which is arranged perpendicular to the previously mentioned adjusting screw, to adjust the hinge in the said direction. A height adjustment of the hinge, that is, an adjustment parallel to the plate-like portion and parallel to the hinge axis, can be effected by an adjustment to the second hinge part.

The described hinge from the prior art therefore has adjustment options along three spatial coordinates arranged mutually perpendicular, so that this offers a practical solution. However, by fixing the plate-like portion of the intermediate piece using screws, an adjustment of the hinge parallel to the plate-like portion and perpendicular to the hinge axis is only possible if two screws are released beforehand. Then an adjustment screw can be actuated, whereupon the screws must be fixed in place again.

SUMMARY

The object of the invention is to provide a door or window hinge which is equipped with improved adjustment elements.

This object is achieved with one or more of the features of the invention described below.

Advantageous embodiments of the invention are given in the dependent claims.

The invention extends the door or window hinge of known generic type by the fact that a head of the adjustment screw is arranged between an intermediate piece and the plate-like portion by means of a clamping device which applies force to the plate-like portion and the intermediate piece from opposite sides and thus holds them together. In contrast to the technology of the prior art, the plate-like portion and the intermediate piece are not permanently screwed together, rather the components are held together with a clamping device. This clamping together, or pressing together of a plate-like portion and an intermediate piece on the one hand enables a screw head to be held, which is assigned to a screw for adjusting the hinge perpendicular to the plate-like portion and perpendicular to the hinge axis. Since the plate-like portion and the intermediate piece are not screwed together, it is also not necessary to release any bolts which are screwed into the intermediate piece, as in the prior art in accordance with DE 10 2007 028 218 B3, in order to adjust the hinge parallel to the plate-like portion and perpendicular to the hinge axis.

It is particularly preferable that the head of the adjustment screw is held between the intermediate piece and the plate-shaped portion in the direction of the axis of the adjustment screw with little or no play. This allows the hinge to be adjusted very precisely, because due to the small amount of play, or the lack of play of the screw head mounting, a particular screw rotation corresponds exactly to a particular adjustment of the hinge perpendicular to the plate-like portion and perpendicular to the hinge axis.

In accordance with an advantageous embodiment of the door or window hinge, it is provided that the plate-like portion and the intermediate piece are held together from one side with a clamping bolt and from the other side with a sleeve fitted onto the clamping bolt. This is a useful solution for holding the plate-like portion and the intermediate piece together, without any screws having to be screwed into the intermediate piece. The sleeve which is fitted can be, for example, pressed or screwed on.

In accordance with a particularly preferred embodiment of the present invention, it is provided that the intermediate piece and the plate-like portion can be moved relative to one another by a rotary device by means of an eccentric. An eccentric is able to convert a rotary motion into a linear motion. The adjustment of the hinge parallel to the plate-like spacer and perpendicular to the hinge axis can therefore be effected by simple rotation of the eccentric, by virtue of the latter moving the plate-like portion and the intermediate piece towards each other.

Advantageously, it is provided that the eccentric consists of at least two cylindrical sections which are moved relative to each other on their mutual axis.

It is also advantageous in this context that the eccentric comprises a bolt-like shaft, which is pressed into a sleeve that is designed so as to be displaceable in an axial direction of the sleeve in a hole drilled in the retaining part. The axial displaceability of the sleeve in the drilled hole in the retaining part ensures that an adjustment of the position of the hinge perpendicular to the retaining part and perpendicular to the hinge axis is not impeded by the eccentric. Due to the mounting of the sleeve in the retaining part preferably without play, during rotation of the eccentric a precise displacement of the hinge takes place parallel to the plate-like portion and perpendicular to the hinge axis.

It is of particular advantage that the clamping bolt and the eccentric are designed as one component. Even if it is possible in principle to use two different components for clamping together the plate-like portion and intermediate piece on the one hand and the adjustment of the relative position of these two components on the other, it is particularly useful to combine these two functions in one component.

The door or window hinge according to the invention is extended in a particularly advantageous manner by the adjusting screw having an inner head engagement portion which has a smaller outside diameter than an adjustment opening aligned flush with the adjustment screw in the plate-like portion. This enables access to the adjustment screw using a tool.

It can be further provided that a second hinge part comprises an adjusting bolt which is oriented and adjustable in the direction of the hinge axis, and which can be rigidly connected to the plate-like portion. The adjustment of the hinge parallel to the hinge axis and parallel to the plate-like portion is therefore implemented in the second hinge part, which advantageously limits the complexity required in the first hinge part.

In this context it can be advantageously provided that the adjusting bolt is held at an axial end of an axially acting screw, wherein the adjustment bolt being adjustable by turning the axially acting screw. An adjustment of the hinge parallel to the hinge axis, and therefore also parallel to the plate-like portion, can therefore be achieved very conveniently by simply turning an axially acting screw.

In a particularly beneficial way, it can be alternatively provided that the axially acting screw can be screwed into both ends of the second hinge part. This allows the hinge to be used in both vertical orientations, in other words in doors or windows with a right-hand or left-hand stop.

BRIEF DESCRIPTION OF THE DRAWINGS

An example of the invention will now be described with reference to the accompanying drawings and on the basis of a particularly preferred embodiment.

Shown are.

DETAILED DESCRIPTION OF THE PREFERRED EMBODIMENTS

Figure 1:
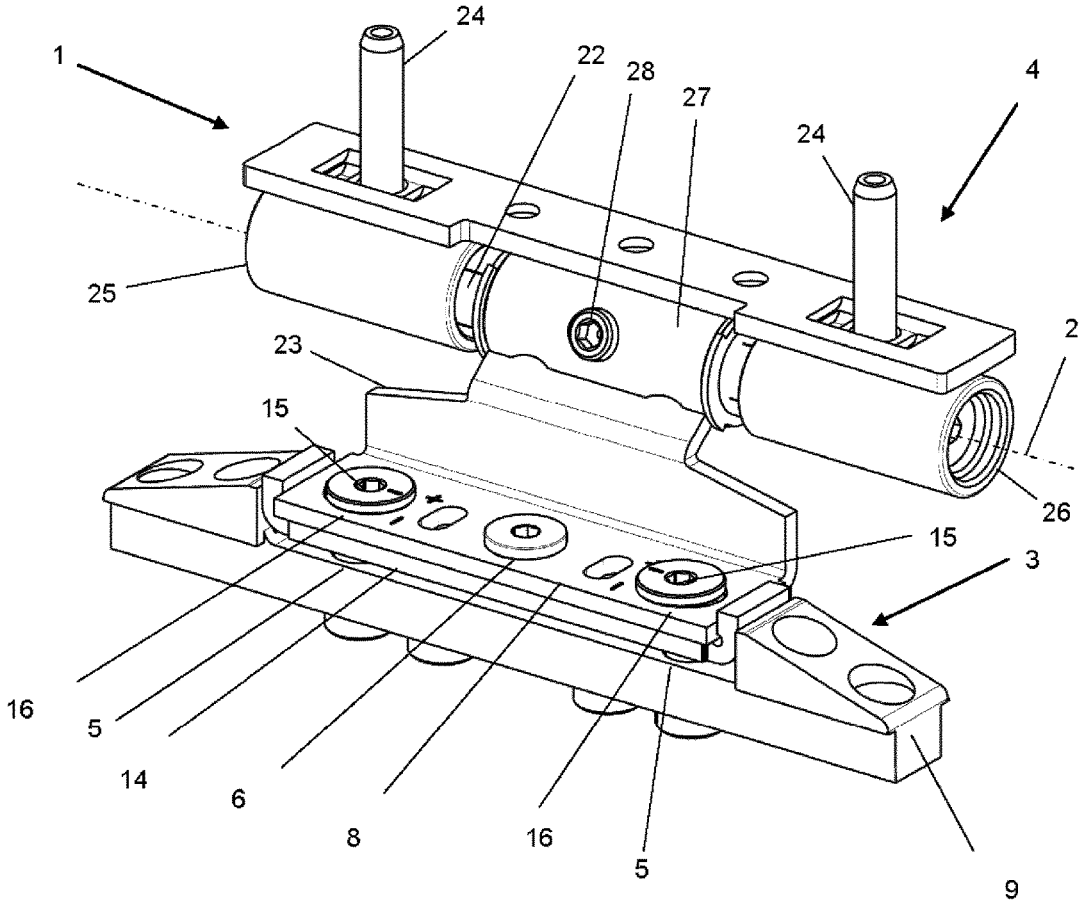
FIG. 1 a perspective view of a hinge according to the invention.

In the following description of the drawings, the same reference numerals designate identical or comparable components.

Figure 2:
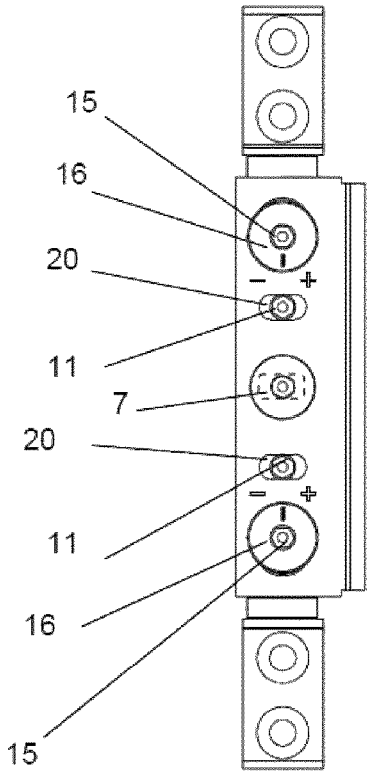
FIG. 2 a plan view, perpendicular to the hinge axis, of the first hinge part of a hinge according to the invention.
Figure 3:
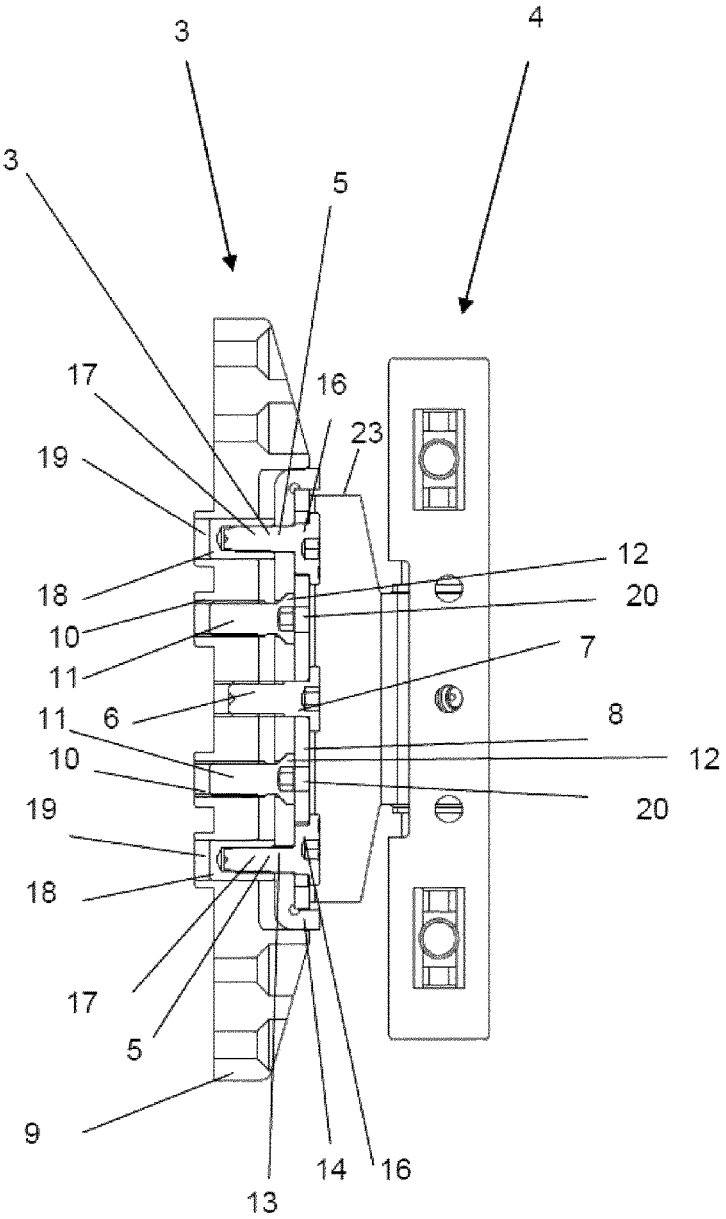
FIG. 3 a partially cut side view of a hinge according to the invention.
Figure 4:
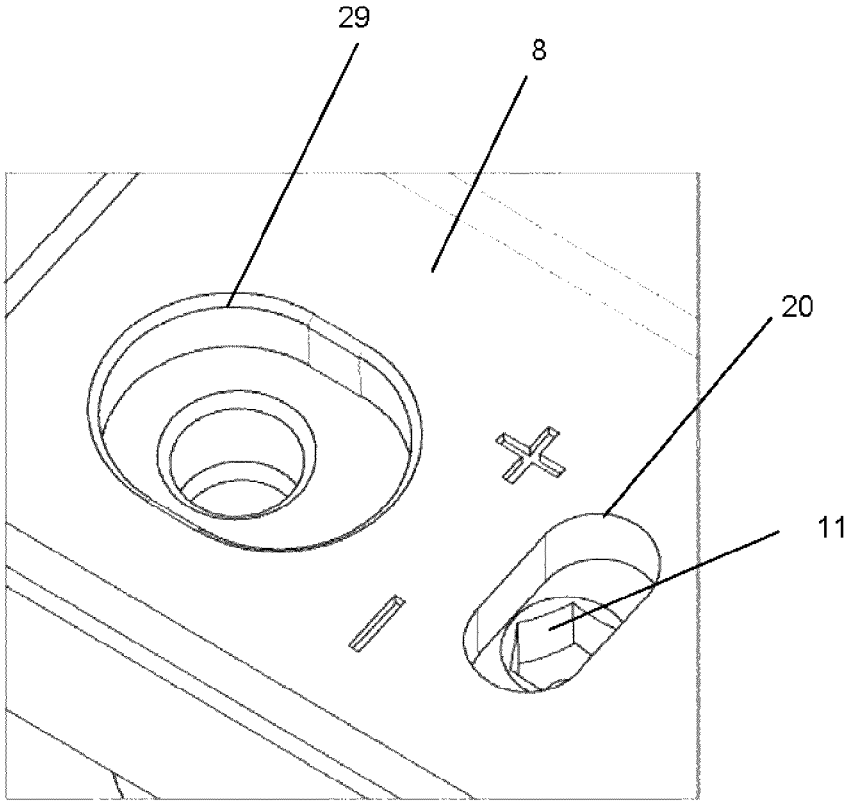
FIG. 4 a partial perspective view of the first hinge part.

FIG. 1 shows a perspective view of a hinge 1 according to the invention. FIG. 2 shows a plan view, perpendicular to the hinge axis 2, of the first hinge part 3 of a hinge 1 according to the invention. FIG. 3 shows a partially cut side view of a hinge 1 according to the invention. FIG. 4 shows a partial perspective view of the first hinge part 3. The door or window hinge 1 shown comprises a first hinge part 3 and a second hinge part 4. The first hinge part 3 and the second hinge part 4 are connected together via a connection plate 23. The second hinge part 4, which is normally mounted on a door or window frame using the mounting pins 24, has two lateral bearings 25, 26 and a central bearing 27. The bearings 25, 26, 27 are arranged on an adjusting pin 22, the longitudinal extension of which defines the hinge axis 2. The central bearing 27 is rigidly connected to the adjustment bolt 22 via a grub screw 28, while the adjustment bolt 22 can rotate relative to the lateral bearings 25, 26 when the door or the window is pivoted.

The first hinge part 3 comprises a retaining piece 9 with which it can be inserted into a groove of a door or a window. Furthermore, the first hinge part 3 comprises a plate-like portion 8, an intermediate piece 14 and a plurality of mounting and adjusting elements. The structure of the first hinge part 3 can be easily identified on the basis of FIG. 3. The plate-like portion 8 and the intermediate piece 14 are held together by means of clamping bolt 13, onto which a sleeve 18 is mounted. The clamping bolt 13 and the sleeve 18 together form a clampinig device 5. The intermediate piece and the plate-like 14 portion 8 are designed so as to hold a head 12 of an adjustment screw 11, wherein this head 12 is received by the intermediate piece 14 and the plate-like portion 8 with as little play as possible, or with no play at all. The plate-like portion 8 has longitudinal hole-like adjustment holes 20, through which the head 12 of the adjustment bolt 11 is accessible using a tool, in this example using an Allen key. The arrangement of plate-like portion 8, intermediate piece 14 and adjusting screws 11, held together thus by the clamping bolt 13 and sleeves 18, is connected to the retaining piece 9 by the fact that the adjusting screw 11 is screwed into a thread 10 of the retaining piece 9. This attachment of the arrangement consisting of the plate-like portion 8, intermediate piece 14 and adjusting screws 11 with the retaining piece 9 is not impeded by the clamping bolt 13 or the sleeves 18 placed thereon, because the sleeves 18 are displaceable in drilled holes 19 of the retaining piece 9 provided for this purpose and thereby provide an additional guide. The whole arrangement described is then also secured by means of a fixing screw 6. The fixing screw 6 rests with its screw head on the plate-like portion, it passes through openings in the plate-like portion 8 and the intermediate piece 14, wherein the hole in the plate-like portion 8 is designed as a longitudinal slot 7 and it is screwed into a thread of the retaining piece 9. Since in the plan view of FIG. 2 the longitudinal slot 7 is hidden by the screw head of the fixing screw 6, this is shown here by a broken line.

The clamping device 5, which comprises a bolt-type shaft 17 and an sleeve 18 connected to it, has as a further special feature, on the end facing away from the sleeve 18, an eccentric 16. The entire clamping device 5 with eccentric 16 in this example therefore comprises two cylindrical sections, i.e. the bolt-like shaft 17 and the eccentric 16, whose axes run parallel and are offset with respect to each other, and also the sleeve 18 which is arranged on the side of the clamping device facing away from the eccentric. The eccentric 16 rests with a collar on the plate-like portion, and it is guided by means of a longitudinal slot 29 in the plate-like portion. The bolt-like shaft 17 adjoining the latter passes through an opening in the intermediate piece 14. The collar of the eccentric 16 and the sleeve 18 of the clamping device 5 generate the opposing force components which hold the plate-like portion 8 and the intermediate piece 14 together.

An adjustment of the hinge perpendicular to the plane of the plate-like portion 8 and perpendicular to the hinge axis 2 is effected in accordance with the above described assembly of the first hinge part 3. A tool is passed through the adjustment opening 20 into the head 12 of the adjustment screw 11. By the adjusting screws 11 being screwed into the thread 10 of the retaining piece to a greater or lesser extent, the desired position of the hinge is obtained. The sleeves 18 slide in the holes 19 provided in the retaining piece 9 as guides.

If an adjustment of the hinge parallel to the plane of the plate-like portion 8 and perpendicular to the hinge axis 2 is to be made, then the eccentrics 16 are used. The eccentrics 16 in FIG. 2 and FIG. 3 are in their central position. If by means of a rotary device 15 of the eccentric 16 the latter is turned in the "+" or "−" direction, the plate-like portion 8 moves relative to the intermediate piece and the retaining piece 9, allowing an adjustment of the hinge in the above-mentioned direction to be performed. Before this adjustment operation the fixing screw 6 is preferably released, thereby reducing the friction between the plate-like portion 8 and the intermediate piece 14. After the adjustment operation the fixing screw 6 can be re-tightened.

Figure 5:
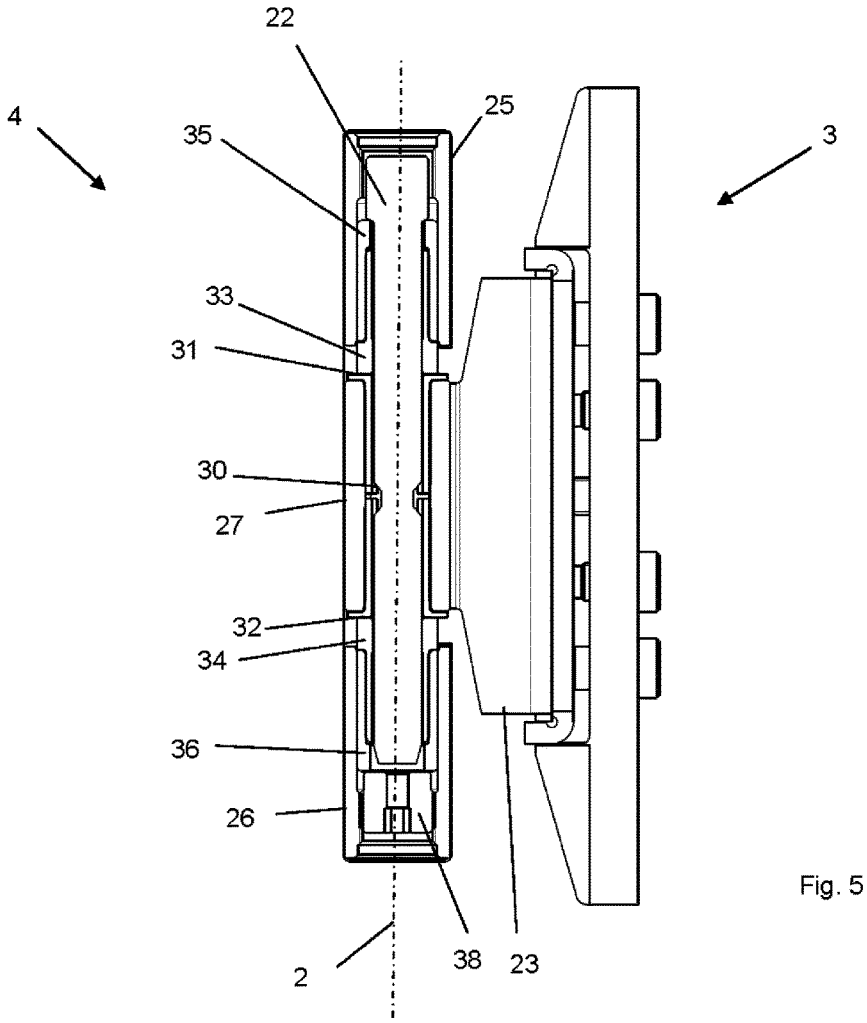
FIG. 5 a partially cut side view of a hinge according to the invention.
Figure 6:
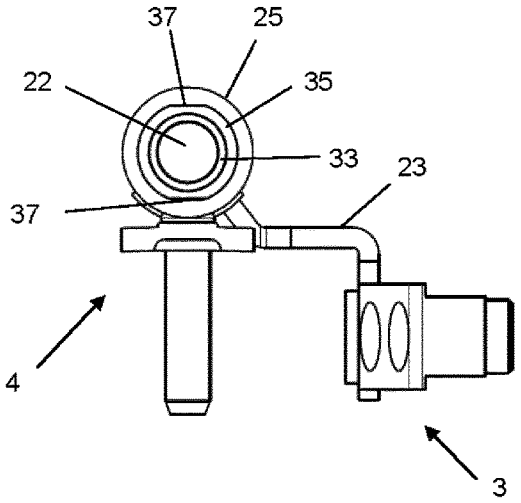
FIG. 6 a partially cut plan view, in the direction of the hinge axis, of a hinge according to the invention.

FIG. 5 shows a partially cut side view of a hinge 1 according to the invention. FIG. 6 shows a partially cut top plan in the direction of the hinge axis 2 of a hinge 1 according to the invention. The second hinge part 4 comprises a adjusting bolt 22 already mentioned, which acts as the axis for the two lateral bearings 25, 26 and a central bearing 27 and defines the hinge axis 2. The adjusting bolt 22 is connected to the central bearing 27 via a grub screw 28 (see FIG. 1). For this purpose the adjusting bolt 22 comprises a constriction 30. The central bearing 27, which is connected via the connection plate 23 to the first hinge part 3 and turns together with the door, is fitted with sockets 31, 32, 33, 34, which can be displaced relative to steel rings 35, 36 of the lateral bearing 25, 26. The steel rings 35, 36 of the lateral bearings 25, 26 are displaceable relative to the lateral bearings 25, 26. In order to prevent the steel rings 35, 36 from turning in the lateral bearings 25, 26, these rings are not designed completely round, rather they have one or more flattened regions 37.

Since the adjusting bolt 22 is thus axially displaceable relatively to the lateral bearings 25, 26, this can be fixed in its axial position. This is effected via an axially acting screw 38, preferably a grub screw, which is screwed into the end of the lateral bearing 26 and via which the hinge can be adjusted in the direction of the hinge axis 2. It is possible to unscrew the axially acting screw 38 out of the lateral bearing 26 completely, to arrange the adjustment bolt 22 the other way around than shown in FIG. 5 and then to screw the grub screw 38 into the other lateral bearing 25. In this way it is possible to produce a left-hand hinge from a right-hand hinge and vice versa.

The features of the invention disclosed in the description, the claims and the drawings can be essential to the implementation of the invention both individually and in any desired combination.

LIST OF REFERENCE NUMERALS

1 door or window hinge
2 hinge axis
3 first hinge part
4 second hinge part
5 clamping device.
6 fixing screw
7 longitudinal slot
8 plate-like portion
9 retaining piece
10 thread
11 adjustment screw
12 head
13 clamping bolt
14 intermediate piece
15 rotating device
16 eccentric
17 bolt-like shaft
18 sleeve
19 drilled hole
20 adjustment opening
22 adjustment bolt
23 connection plate
24 mounting pin
25 lateral bearing
26 lateral bearing
27 central bearing
28 grub screw
29 longitudinal slot
30 constriction
31 socket
32 socket
33 socket
34 socket
35 steel ring
36 steel ring
37 flattended region
38 axially acting screw

The invention claimed is:

1. A door hinge (1) or window hinge (1) comprising two hinge parts (3, 4) which are operatively connected to one another so as to be rotatable about a common hinge axis (2), at least one door- or window-side first one of the hinge parts (3) has a plate-shaped portion (8) which interacts in a fixedly and releasably connectable manner with a retaining piece (9) which is insertable into a groove in an end side of the door or window, wherein the plate-shaped portion (8) is oriented in a first plane running parallel to the hinge axis (2) and is adjustable with respect to the retaining piece (9) in a second plane running at a right angle to the first plane of the plate-shaped portion (8), and an adjustment screw (11) is screwed into at least one thread (10) of the retaining piece (9), an axis of the adjustment screw (11) runs perpendicular to the first plane of the plate-shaped portion (8), a head (12) of the adjustment screw (11) is arranged and held between an intermediate piece (14) and the plate-shaped portion (8) in a direction of the axis of the adjustment screw (11) with little or no play by a clamping device (5), which applies force to the plate- shaped portion (8) and the intermediate piece from opposite sides and thus holds them together, said clamping device (5) comprising a clamping bolt (13) and a sleeve (18) arranged such that the plate-shaped portion (8) and the intermediate piece (14) are held together from one side with said clamping bolt (13) and from the other side with said sleeve (18) fitted onto the clamping bolt (13), the intermediate piece (14) and the plate-shaped portion (8) are displaceable relative to each other by an eccentric (16) including at least two cylindrical sections having axes that are offset relative to each other, and the clamping bolt and the eccentric (16) are formed as one component comprising a bolt-shaped shaft (17), which is pressed into the sleeve (18) such that the sleeve (18) is displaceable in an axial direction of the sleeve (18) in a hole (19) in the retaining part (9).

2. The door or window hinge according to claim 1, wherein the adjustment screw (11) has an inner head engagement portion having a smaller outside diameter than an adjustment opening (20) in the plate-shaped portion (8) aligned flush with the adjustment screw (11).

3. The door or window hinge according to claim 1, wherein a second one of the hinge parts (4) comprises an adjustment bolt (22) which is aligned and adjustable in a direction of the hinge axis, which is rigidly connected to the plate-shaped portion (8).

4. The door or window hinge according to claim 3, wherein the adjustment bolt (22) is held at one axial end of an axially acting screw (38), and the adjustment bolt (22) is adjustable by turning the axially acting screw (38).

* * * * *